US006253852B1

(12) United States Patent
Nobileau

(10) Patent No.: US 6,253,852 B1
(45) Date of Patent: Jul. 3, 2001

(54) LATERAL BRANCH JUNCTION FOR WELL CASING

(76) Inventor: Philippe Nobileau, 2 Avenue Femand Martin, F-06240 Villefranche sur Mer (FR)

( * ) Notice: Subject to any disclaimer, the term of this patent is extended or adjusted under 35 U.S.C. 154(b) by 0 days.

(21) Appl. No.: 09/448,772

(22) Filed: Nov. 24, 1999

Related U.S. Application Data

(63) Continuation-in-part of application No. 09/148,667, filed on Sep. 4, 1998, now abandoned, which is a continuation-in-part of application No. 08/925,971, filed on Sep. 9, 1997, now Pat. No. 5,979,560.

(60) Provisional application No. 60/109,842, filed on Nov. 25, 1998.

(51) Int. Cl.[7] ..... E21B 7/06

(52) U.S. Cl. ..... 166/313; 166/50; 166/117.6; 166/207; 166/242.1; 166/381

(58) Field of Search ..... 166/50, 313, 117.6, 166/242.1, 381, 207, 242.2

(56) References Cited

U.S. PATENT DOCUMENTS

| | | | | |
|---|---|---|---|---|
| 3,489,220 | | 1/1970 | Kinley . | |
| 5,318,122 | | 6/1994 | Murray et al. . | |
| 5,337,823 | | 8/1994 | Nobileau . | |
| 5,388,648 | * | 2/1995 | Jordan, Jr. | 166/380 |
| 5,425,559 | | 6/1995 | Nobileau . | |
| 5,458,209 | | 10/1995 | Hayes et al. . | |
| 5,464,062 | | 11/1995 | Blizzard, Jr. . | |
| 5,477,925 | | 12/1995 | Trahan et al. . | |
| 5,520,252 | | 5/1996 | McNair . | |
| 5,526,880 | | 6/1996 | Jordan, Jr. et al. . | |
| 5,564,503 | | 10/1996 | Longbottom et al. . | |
| 5,875,847 | * | 3/1999 | Forsyth | 166/313 |
| 5,944,107 | | 8/1999 | Ohmer . | |
| 5,979,560 | * | 11/1999 | Nobileau | 166/381 |
| 6,056,059 | * | 5/2000 | Ohmer | 166/313 |
| 6,079,495 | * | 6/2000 | Ohmer | 166/313 |

FOREIGN PATENT DOCUMENTS

| | | |
|---|---|---|
| EP0795679A2 | 9/1997 | (EP) . |
| WO96/22452 | 7/1996 | (WO) . |
| WO99/04135 | 1/1999 | (WO) . |

* cited by examiner

*Primary Examiner*—Hoang Dang
(74) *Attorney, Agent, or Firm*—Bracewell & Patterson LLP; James E. Bradley

(57) ABSTRACT

A well casing junction connects an upper string of casing to a pair of lower or branch strings that diverge from each other. The junction tool has an upper section and a pair of branch sections that join the upper section and each other. The junction tool is collapsed for running into the well along with casing. To collapse, a force is applied to opposite sides to create identical, deep depressions in the opposite sides of the junction tool. Once in position, internal pressure forces the depressions outward to assume an expanded position. A support member locates at the junction and between the two branch sections. The support member reduces stress that occurs from moving from the collapsed to the expanded position.

22 Claims, 5 Drawing Sheets

LATERAL BRANCH JUNCTION FOR WELL CASING

CROSS-REFERENCE

This is a continuation-in-part application of Ser. No. 09/148,667, filed Sep. 4, 1998, now abandoned, which was a continuation-in-part of Ser. No. 08/925,971, filed Sep. 9, 1997, U.S. Pat. No. 5,979,560. This application also claims priority to provisional application Ser. No. 60/109,842, filed Nov. 25, 1998.

TECHNICAL FIELD

This invention relates in general to the construction of a lateral branch for a primary well and particularly to a junction member which sealingly connects the main borehole casing and the branch liner casing.

BACKGROUND ART

In recent years, well construction technology has yielded substantial increases in well productivity with the spread of horizontal drilling for the bottom end section of the well. Unfortunately horizontal drilled wells provide limited zonal isolation and do not always permit good completion practices regarding the independent production of different production zones. Research efforts are now concentrating on the possibility of drilling lateral branches either inclined or horizontal from a primary well to enhance further reservoir productivity. Also lateral branches open the potential of tapping several smaller size reservoirs spread around from one single well without the need to sidetrack and redrill the well when moving the production from one production zone to the next. The challenge with multilateral completion is to install a junction apparatus having adequate internal and external pressure capability without relying only on the strength of the local rock formations.

Some prior art junction apparatus designs are based on a low angle side branch casing connected to a window on the main borehole casing. Some prior proposals require in situ milling of a window or a section in the main borehole casing. Milling steel casing downhole is a difficult task. Also, while there are numerous proposals for sealing the branch liner casing to the window, improvements are needed. One design deforms a complete junction assembly to offer a diameter equal or less than the diameter of the main borehole casing and expanding it in situ to the full cylindrical shape. In that design, the junction assembly may be elastomeric or memory metal. The junction assembly is expanded within an enlarged section of the well formed after a section of the casing is milled out.

Due to the side window based connecting link between the main borehole casing and the branch outlet, all these configurations offer poor internal pressure capacity and even more limited collapse capability when the junction is located in unconsolidated or weakly consolidated formations. The poor internal pressure capability and resistance to collapsing exists even when they are fully cemented since cement does not work well in traction. It is therefore highly desirable to have a junction apparatus offering good internal pressure and collapse capability to permit a wide freedom in the location of lateral junction independent from the strength of the cementing job and/or surrounding rock formation.

SUMMARY OF INVENTION

The junction apparatus in this invention has an upper section that connects to an upper string of casing. A pair of branch sections join each other at a junction with each other and with a lower end of the upper section. Each branch connects to a lower string of casing. The apparatus is forced into a collapsed configuration prior to running into the well. While in the well, the apparatus is expanded back to an expanded configuration. While in the collapsed position, a lower portion of the upper section is deformed so that a pair of deep depressions or bights locates on the outer side, the depressions being 180 degrees apart from each other and facing in opposite directions. Also, these depressions extend into an upper portion of the branch sections.

In addition, a support member is joined to the upper section at the junction, the support member having a tail section that extends between the branch sections. The support member has arms that extend upward and join the upper section. The tail section comprises a pair of braces interconnected by a web. The web defines an inner separation wall between the two branch sections and preferably has a portion of substantially constant thickness.

While in the well, internal pressure is applied to force the depressions to disappear.

The upper section will expand in diameter. The branch sections move outward and assume a cylindrical configuration.

BEST MODE FOR CARRYING OUT THE INVENTION

Figure 1:
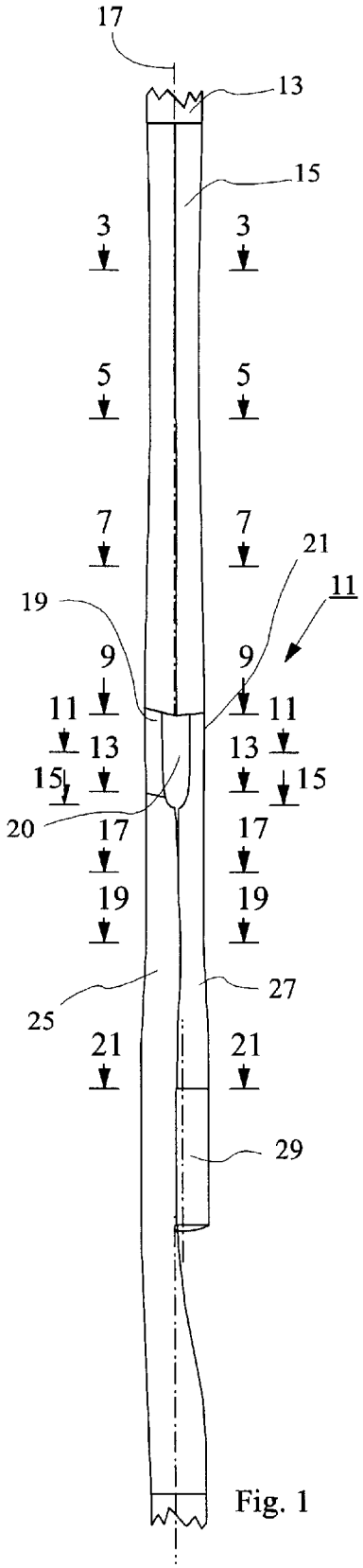
FIG. 1 is a side elevational view illustrating a junction apparatus in accordance with this invention connected into a main string of casing and shown in a collapsed position.
Figure 2:
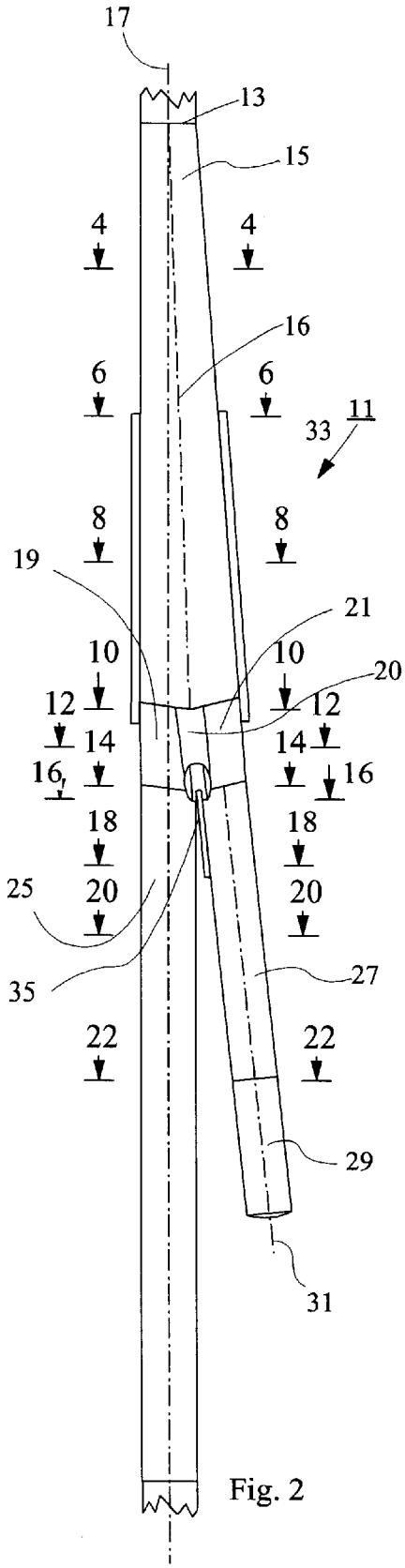
FIG. 2 is a side elevational view similar to FIG. 1, but showing the junction apparatus expanded to a set position.

Referring to FIG. 1 and 2, the junction apparatus or member 11 is connected into a string of casing and lowered into an open hole wellbore until it reaches an enlarged section of the wellbore. Junction member 11 then is pressurized by fluid pressure from the surface, causing it to move from the collapsed position in FIG. 1 to the expanded set position of FIG. 2. While in the expanded position, junction member 11 resembles an inverted "Y".

Junction member 11 has an upper end section 13 that is cylindrical and connects into the string of casing that is being lowered into the wellbore. Upper end section 13 is the same diameter as the casing. An upper enlarged section 15 joins upper end section 13, having an upper end welded to the lower end of upper end section 13. Upper enlarged section 15 is conical, diverging in a downward direction and resulting in a greater diameter at its lower end at section line 10—10 than at its upper end. Upper enlarged section 15 has an axis 16 that is inclined relative to main casing axis 17.

Figure 16:
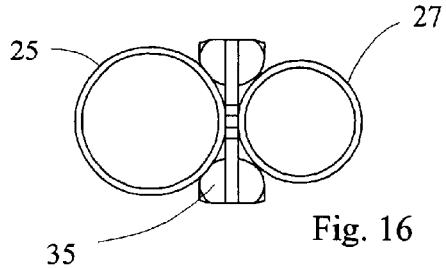
FIG. 16 is a sectional view similar to FIG. 15, but taken along the line 16—16 of FIG. 2 to show the junction apparatus expanded.
Figure 17:
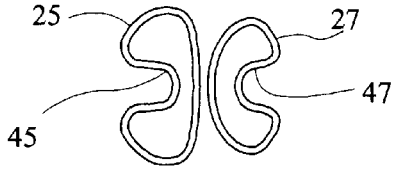
FIG. 17 is a sectional view of the junction apparatus of FIG. 1, taken along the line 17—17 of FIG. 1.
Figure 18:
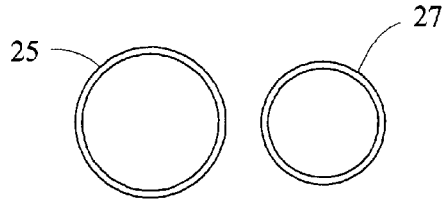
FIG. 18 is a sectional perspective view of the junction similar to FIG. 17, but taken along the line 18—18 of FIG. 2 to show the junction apparatus expanded.
Figure 19:
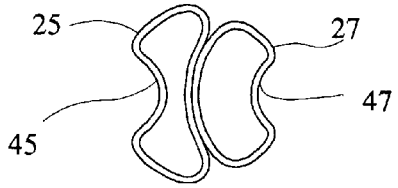
FIG. 19 is a sectional view of the junction apparatus of FIG. 1, taken along the line 19—19 of FIG. 1.
Figure 20:
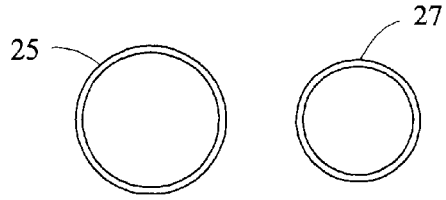
FIG. 20 is a sectional view similar to FIG. 19, taken along the line 20—20 of FIG. 2 to show the junction apparatus expanded.
Figure 21:
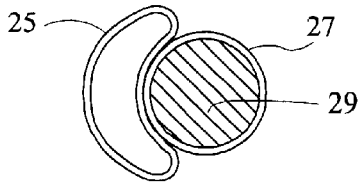
FIG. 21 is a sectional view of another embodiment of the junction apparatus of FIG. 1, taken along the line 21—21 of FIG. 1.
Figure 22:
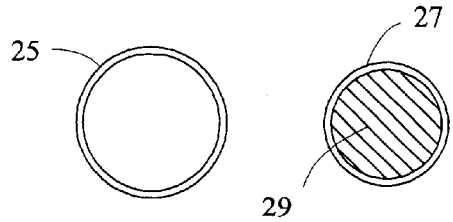
FIG. 22 is a sectional view of the junction apparatus similar to FIG. 4, but shown taken along the line 22—22 of FIG. 2 to show the junction apparatus expanded.

A conical lower enlarged section 19 has an upper end welded to part of the lower end of upper enlarged section 15. In the embodiment shown, conical lower enlarged section 19 is much shorter in length than the length of upper enlarged section 15. Conical lower enlarged section 19 converges in a downward direction, as can be seen by comparing FIGS. 12 and 16. Conical lower enlarged section 19 comprises one-half of a cone with a diameter at its lower end that is substantially the same as the diameter of upper end section 13.

Figure 12:
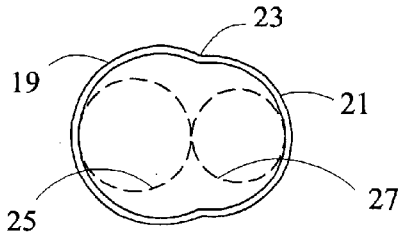
FIG. 12 is a view similar to FIG. 11, but taken along the line 12—12 of FIG. 2 to show the junction apparatus expanded.
Figure 13:
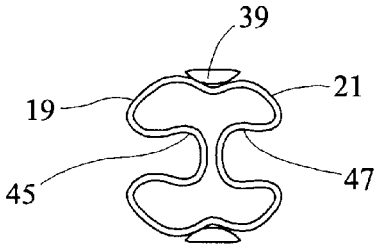
FIG. 13 is a sectional view of the junction apparatus of FIG. 1, taken along the line 13—13 of FIG. 1.
Figure 14:
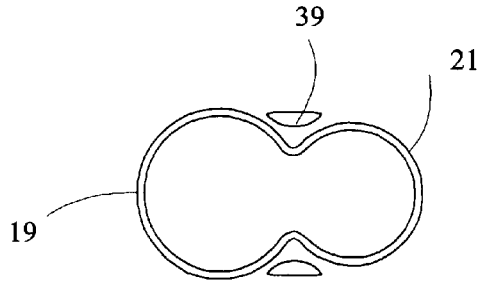
FIG. 14 is a sectional view similar to FIG. 13, but taken along the line 14—14 of FIG. 2 to show the junction apparatus expanded.
Figure 15:
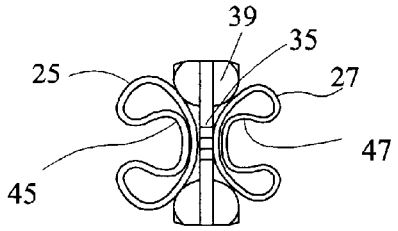
FIG. 15 is a sectional view of the junction apparatus of FIG. 1, taken along the line 15—15 of FIG. 1.

A conical lower enlarged section 21 also joins the lower end of upper enlarged section 15. Conical lateral section 21 may be the same length as conical lower enlarged section 19, but is preferably of a lesser diameter. Both conical lower enlarged section 19 and 21 are joined together via a formed section 10 which contains U-shaped portion 43. Referring to FIG. 12, conical lateral section 21 forms the right half of junction member 11 at section line 12—12, with conical lower enlarged section 19 forming the left half at that point. Conical lower enlarged section 19 and lateral section 21 are welded to each other along their inner edges 23, the inner edges being in a plane that contains axis 16 of upper enlarged section 15. The shape of junction member 11 at section line 12—12 is somewhat in the shape of a peanut, with a major dimension that is greater than a minor dimension.

Referring again to FIG. 2, a lower main section 25 of cylindrical configuration is welded to the lower end of conical lower enlarged section 19. Lower main section 25 joins the main casing branch (not shown) extending below and is coaxial with upper end section 13 and main axis 17. A lower lateral section 27 of cylindrical configuration is welded to the lower end of conical lateral section 21. Lower lateral section 27 will support a string of lateral or branch casing (not shown). A drillable plug 29 is secured in lower lateral section 27. The diameter of lower lateral section 27 is preferably slightly smaller than the diameter of lower main section 25. Lower lateral section 27 is located on a lateral branch axis 31 that is at an acute angle relative to main casing axis 17. Upper enlarged section axis 16 bisects axes 17 and 31, with all three axes 16, 17 and 31 being in a single plane.

For collapsing purposes, a plurality of forming rods 33 are secured to junction apparatus 11. In the preferred embodiment, four forming rods 33 are employed, and they are welded to the exterior of upper enlarged section 15. The lower ends of forming rods 33 extend into conical lower enlarged section 19 and conical lateral section 21.

Figure 23:
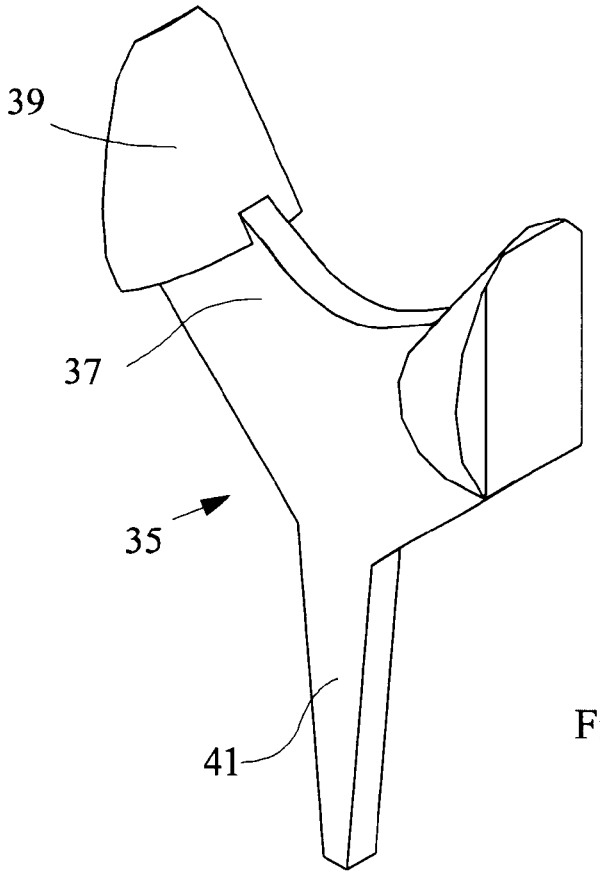
FIG. 23 is a perspective view of a support member for the junction apparatus of FIG. 2.
Figure 24:
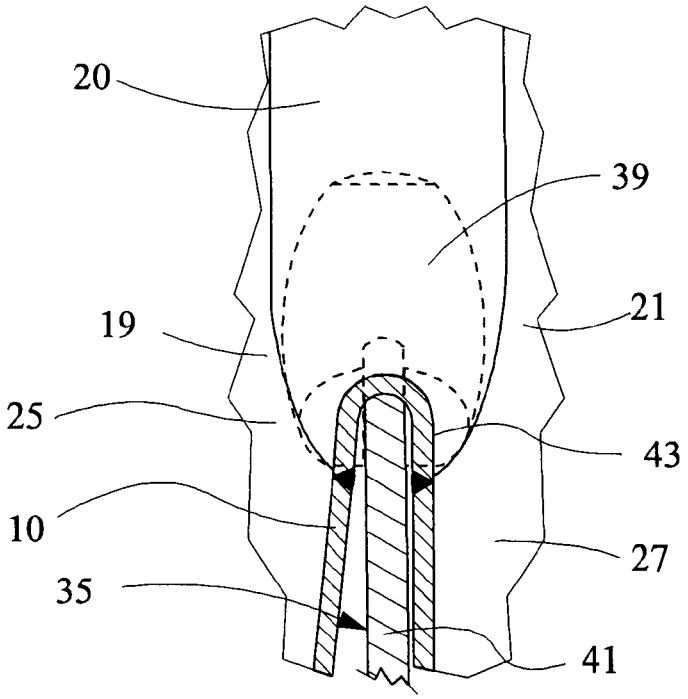
FIG. 24 is an enlarged, partially sectional view of the support member of FIG. 23 installed in the junction apparatus of FIG. 2.

Referring to FIGS. 2, 23 and 24, a support member 35 is welded to the exterior of junction member 11 at the intersection of lower main section 25 and lower lateral section 27. These two sections join each other at the lower end of the conical lower enlarged section 19 and conical lateral section 21. The junction resembles a crotch area with the two legs being lower main branch portion 25 and lower lateral branch portion 27. For clarity, support member 35 is not shown in FIG. 1.

Support member 35 is generally in the configuration of a "Y", having two arms 37 and a leg 41. Each arm 37 has an enlarged portion 39 on its outer end. The enlarged portions 39 are welded to the exterior of conical enlarged section 19 and conical lateral section 21 on opposite sides. Leg 41 inclines parallel to lateral branch axis 31 and is welded to an inner side of lower lateral portion 27. The curved upper portion between arms 37 abuts against a U-shaped portion 43 formed at the crotch between conical lower enlarged section 19 and conical lateral section 21.

Figure 3:
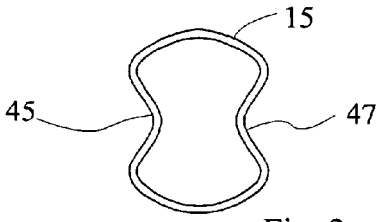
FIG. 3 is a sectional view of the junction apparatus of FIG. 1, taken along the line 3—3 of FIG. 1.
Figure 4:
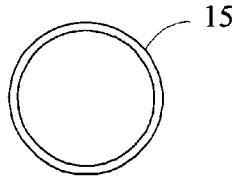
FIG. 4 is a sectional view similar to FIG. 3, but taken along the line 4—4 of FIG. 2 to show the apparatus expanded.
Figure 5:
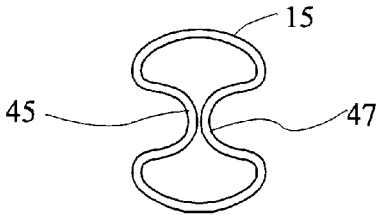
FIG. 5 is a sectional view of the junction apparatus of FIG. 1, taken along the line 5—5 of FIG. 1.
Figure 6:
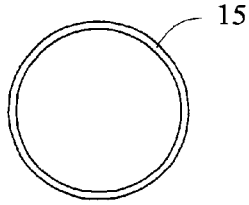
FIG. 6 is a sectional view similar to FIG. 5, but taken along the line 6—6 of FIG. 2 to show the apparatus expanded.
Figure 7:
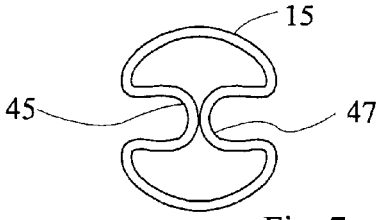
FIG. 7 is a sectional view of the junction apparatus of FIG. 1, taken along the line 7—7 of FIG. 1.
Figure 8:
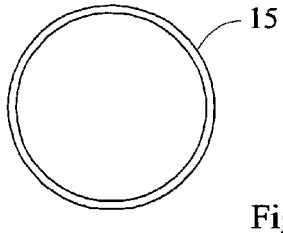
FIG. 8 is a sectional view similar to FIG. 7, but taken along the line 8—8 of FIG. to show the apparatus expanded.
Figure 9:
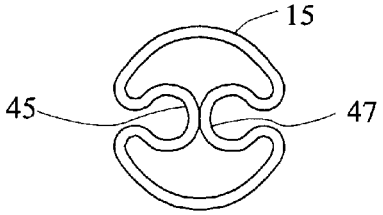
FIG. 9 is a sectional view of the junction apparatus of FIG. 1, taken along the line 9—9 of FIG. 1.
Figure 10:
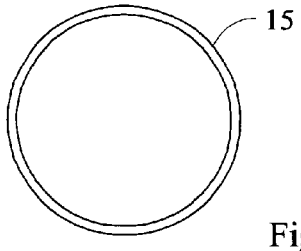
FIG. 10 is a sectional view similar to FIG. 9, but taken along the line 10—10 of FIG. 2 to show the junction apparatus expanded.
Figure 11:
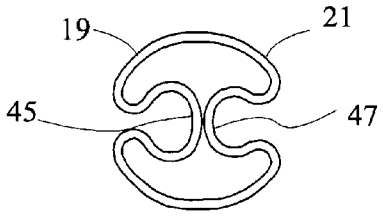
FIG. 11 is a sectional view of the junction apparatus of FIG. 1, taken along the line 11—11 of FIG. 1.

Junction member 11 will first be formed and tested in the expanded configuration of FIG. 2. Then it will be collapsed to the position shown in FIG. 1 for passage into the well. Junction member 11 is collapsed by a folding machine (not shown) which bears against opposites sides, as shown in FIG. 3 in the symmetrical plan, causing the side walls to deflect inward, creating depressions or bights 45, 47 180 apart from each other. Bights 45, 47 increase in depth in a downward direction as can be seen by comparing FIG. 3 to FIG. 5. The shapes of bights 45, 47 will also change in a downward direction as can be seen by comparing FIGS. 5, 7, 9, 11, 13, 15, 17 and 19. In FIG. 5, forming rods 33 are welded into each of the bights 45, 47, preventing an excessive bending radius. There are two of the forming rods 33 in each bight 45, 47. The sides of forming rods 33 in each bight 45, 47 will contact each other in the vicinity of the section line 7—7 and 9—9.

In the collapsed position shown, the enlarged portions 39 of support member 35 are located in a plane that is substantially perpendicular to a plane that bisects each of bights 45, 47. Support member 35 reduces stress during the collapsing process, preventing lower main portion 25 and lower lateral portion 27 from being folded excessively. At the lower end of junction member 11, lower main section 25 will be crescent-shaped, while lower lateral section 27 remains mostly cylindrical and substantially undeflected. A surface of revolution of junction member 11 is cylindrical when junction member 11 is collapsed and no greater at any point than the outer diameter of upper end section 13.

During operation, junction member 11 is installed in a string of casing and lowered into a section of the well that has been previously enlarged by reaming. Junction member 11 will be run while in the collapsed position of FIG. 1. Then, hydraulic pressure is applied to the fluid contained in the main casing and in junction member 11. A plug (not shown) at the cement shoe (not shown) at the lower end of the main casing enables hydraulic pressure to be applied throughout the length of casing and junction member 11. This pressure causes junction member 11 to expand to the set position with lateral leg 27 moving outward. After reaching this position, a valve will be shifted at the cement shoe to enable cement to be pumped downward, which flows through the main casing and back up an annulus surrounding the main casing.

When it is desired to drill the lateral wellbore, the operator uses a deflector (not shown) to cause the drill bit to enter lateral leg 27. The drill bit drills out plug 29 and drills the lateral wellbore. Lateral casing of smaller diameter than the main casing will be run through lateral leg 27 into the lateral wellbore and supported by a hanger mechanism in lateral leg 27. The lateral casing will be cemented conventionally.

Figure 25:
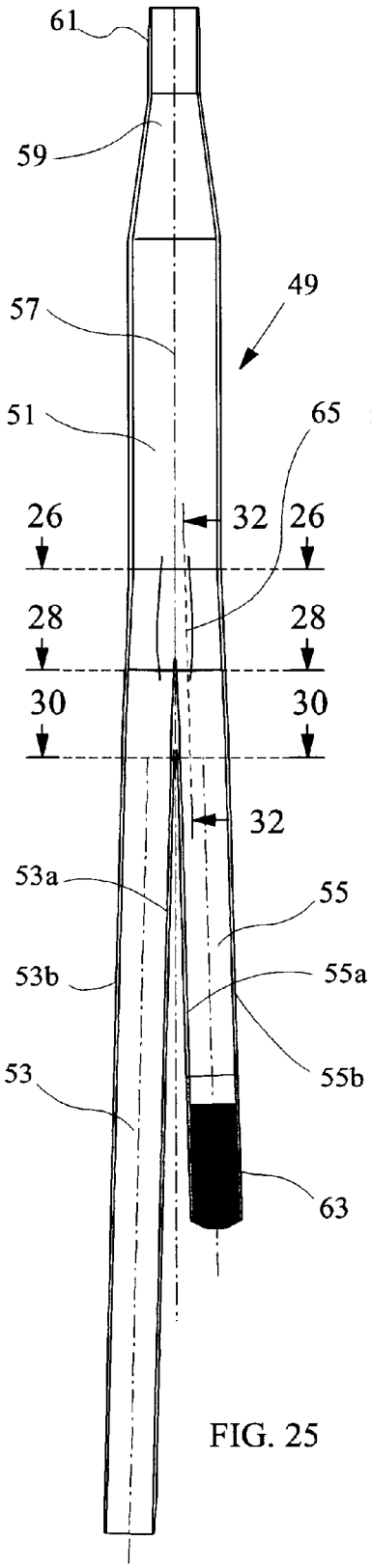
FIG. 25 is a side elevational view of an alternate embodiment of a junction apparatus, shown in an expanded position.
Figure 26:
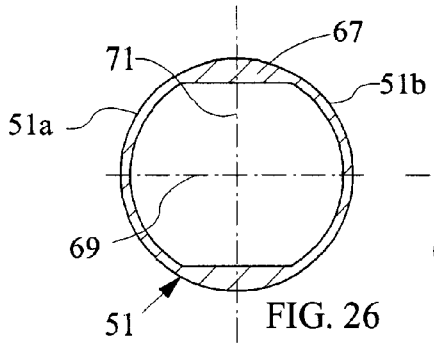
FIG. 26 is a sectional view of the junction tool of FIG. 25, taken along the line 26—26.

FIGS. 25–34 show an alternate embodiment of junction tool 11. Referring to FIG. 25, junction tool 49 has a cylindrical upper section 51. Upper section 51, as shown in FIG. 26, can be considered to have two halves or sidewall portions 51*a*, 51*b* facing in opposite directions. Sidewall portions 51*a*, 51*b* are semi-cylindrical and join each other to form a cylinder. Two branch sections 53, 55 join upper section 51 at a junction and extend downward as shown in FIG. 25. Each branch section 53, 55 in this embodiment is of the same diameter. Each branch section 53, 55 inclines relative to a longitudinal axis 57 of upper section 51 at the same angle. Branch section 53 may be considered to have an inner sidewall portion 53*a* that faces an inner sidewall portion 55*a* of branch section 55. Similarly, branch section 53 has an outer half or sidewall portion 53*b* that faces in an opposite direction and away from outer sidewall portion 55*b* of branch section 55.

Referring again to FIG. 25, a conical section 59 is located at the upper end of upper section 51. Conical section 59 joins a cylindrical end 61 that will secure to a lower end of a string of casing. The lower end of branch section 53 secures to a string of casing while junction tool 49 is being lowered into the well. Initially, branch section 55 will be closed off with a drillable shoe 63. Subsequently, shoe 63 is drilled out for drilling a branch well and running a casing liner into engagement with branch section 55.

Figure 32:
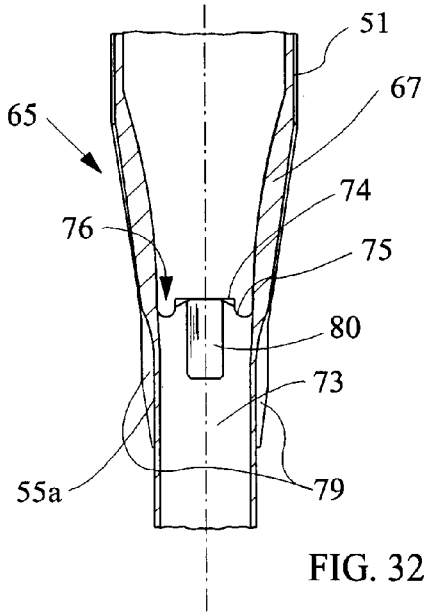
FIG. 32 is a sectional view of the junction tool of FIG. 25, taken along the line 32—32 of FIG. 25.

As shown in FIG. 32, a support member 65 locates where branch sections 53, 55 join upper section 51. Support member 65 is generally in the shape of a "Y", having two upward extending arms 67. Arms 67 are rigidly joined to the lower portion of upper section 51. Referring to FIG. 26, interior portions of arms 67 will protrude inward slightly into the bore of upper section 51.

Figure 28:
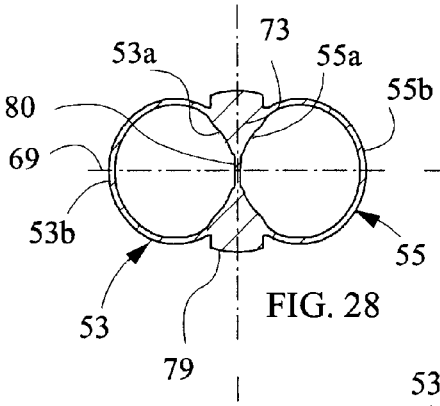
FIG. 28 is a sectional view of the junction tool of FIG. 25, taken along the line 28—28.

Referring to FIGS. 26 and 28, junction tool 49 may be considered to have a major axis or symmetrical axis 69. Major axis 69 bisects equally each of the branch sections 53, 55. A minor axis 71, perpendicular to major axis 69, bisects equally each of the arms 67. As upper section 51 is cylindrical along section line 26—26, the dimensions across upper section 51 at major axis 69 and minor axis 71 will be the same. However, when measured at section line 28—28, the distance from outer side 53*b* to outer side 55*b* along major axis 69 is considerably greater than the distance from the outer surface of each arm 67 measured along minor axis 71.

Referring again to FIG. 32, support member 65 also has a web 73 that joins each arm 67 and extends downward. The upper border end 74 of web 73 is a straight line, with stress relief notches 76 at each comer where upper end 74 joins an arm 67 with a radius 75. While moving between the collapsed and expanded positions, arms 67 will flex at the junction with web 73, thus the stress relief notches 76 with radius comers 75 reduce stress concentration.

Figure 30:
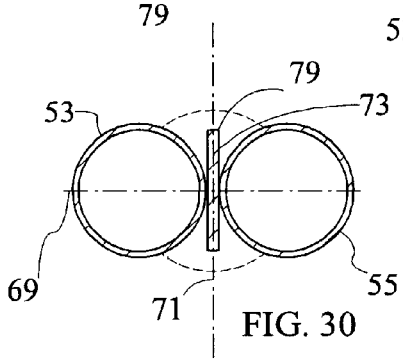
FIG. 30 is a sectional view of the junction tool of FIG. 25, taken along the line of 30—30 of FIG. 25.

Web 73 extend sideways with ribs 79, downward from arms 67. Ribs 79 are connected to each other by web 73, resulting in what may be considered as a tail. By comparing FIGS. 28 and 30, it can be seen that at upper end 74 near section line 28—28, web 73 will form the separating wall between branch sections 53, 55. The inside wall portions 53*a*, 55*a* along section line 28—28 coincide with web 73. As one proceeds downward, however, web 73 becomes a discrete member spaced equidistant between branch sections 53, 55, as shown in FIG. 30 with ribs 79 sticking out. When junction tool 49 is under operating pressure, the upper section of web 73, where it is the separating wall between branch sections 53, 55, will be highly loaded while being limited in its thickness by the required drift of the branches sections 53, 55 and might undergo plastic deformation. To spread the load over a large area, instead of concentrating the highest stresses on a single line, a constant thickness section 80 is formed in web 73. As shown in FIGS. 28, constant thickness section 80 is a flat section located within the center of web 73 between braces 79. Constant thickness section 80 is rectangular and extends downward from upper border end 74 for a selected distance.

Figure 27:
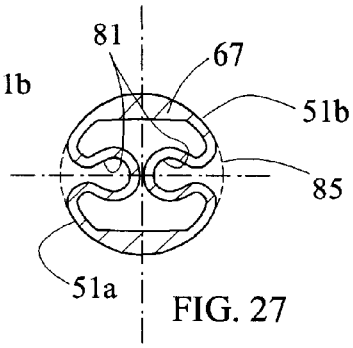
FIG. 27 is a sectional view similar to FIG. 26, but showing the junction tool in a collapsed position.
Figure 29:
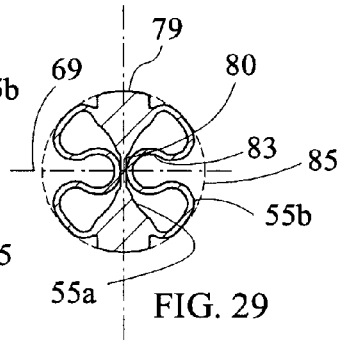
FIG. 29 is a view similar to FIG. 28, but showing the junction tool in a collapsed position.
Figure 31:
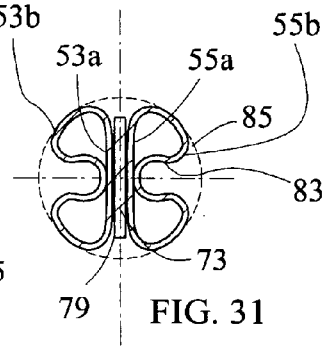
FIG. 31 is a view similar to FIG. 40, but showing the junction tool in a collapsed position.

To move junction apparatus 49 to the collapsed position, shown in FIGS. 27, 29 and 31, deforming round tools (not shown)are applied on each side portion 51*a*, 51*b* along major axis 69. These deforming tools press inward toward each other, each forming a single large depression or bight 81. At section line 26—26, the inner ends of bights 81 are nearly touching each other. Bights 81 face outward in opposite directions from each other. When bights 81 are created, not only will the dimension of upper section 51 shrink along major axis 69, but it will also shrink along minor axis 71. Also, while collapsing, the upper ends of arms 67 move toward each other, resulting in a collapsed position effective diameter 85, shown by the dotted lines.

The same deforming tools also move outer sidewall portions 53*b*, 55*b* of branch sections 53, 55 inward to the position shown in FIG. 29. This results in two bights 83 that are continuations of bights 81. Bights 83 faces in opposite directions and are located along major axis 69. The inner surface of each bight 83 will touch web 73 at the constant thickness section 80. The effective diameter 85 is the same as that in upper section 51.

Referring to FIGS. 30 and 31, in the collapsed position, bights 83 will be in contact with the interior surface of the inner sidewall portions 53*a*, 55*a*. In the collapsed position, inner sidewall portions 53*a*, 55*a* along section line 30—30 will be flat, parallel to each other and parallel to web 73 with sticking out ribs 79, which is equally spaced between.

Junction tool 49 will be employed the same as in the first embodiment. The operator will apply hydraulic pressure to the main casing and the junction tool 49. The hydraulic pressure will cause junction tool 49 to move from the collapsed configuration to the expanded configuration. The operator then cements the casing and junction apparatus in the well.

The operator will then lower drill pipe through the casing and into branch section 55 to drill out plug 63 and to drill the other branch well. After drilling, casing for the other branch well will be lowered through the upper string of casing and through branch section 55. A liner hanger will support the upper end of the second string of casing within branch section 55.

The invention has significant advantages. Collapsing the junction tool by pressing inward on opposite sides to form symmetrical bights provides an effective means to reduce the overall diameter. The support member allows movement from the deformed position to the expanded position while reinforcing the branch junction to support high operating pressures. The stress relief radius reduces stress at the corners between the web and the arms. The constant thickness section in the web spread deformation in the highly loaded separating wall between the branches While the invention has been shown in only two of its forms, it should be apparent to those skilled in the art that it is not so limited, but susceptible to various changes without departing from the scope of the invention.

I claim:

1. A well casing junction apparatus for connecting an upper string of casing to a pair of lower strings of casing, comprising:

an upper section having a longitudinal axis and being adapted to be connected to the upper string of casing above the apparatus;

a pair of branch sections that join each other at a junction with each other and with a lower end of the upper section and extend downward from the upper section for connection to the lower strings of casing;

the apparatus being movable due to the application of internal force from a collapsed position to an expanded position in which both of the branch sections are substantially cylindrical; and wherein while in the collapsed position, a single depression is located on one side of a lower portion of the upper section and a single depression is located on an opposite side of the upper section, the depressions face in opposite directions; and while in the collapsed position, an upper portion of each of the branch sections has an outer side having a single depression that extends downward from one of the depressions from the upper section.

2. The apparatus according to claim 1, wherein while in the collapsed position, an inner side of an upper portion of each of the branch sections is deformed from its configuration while expanded.

3. The apparatus according to claim 1, wherein the depressions on the upper section substantially symmetrical and the depressions on the branch sections are substantially symmetrical.

4. The apparatus according to claim 1, wherein while in the collapsed position, the depression on the outer side of each of the branch sections extends inward into substantial contact with an interior surface of an inner side of each of the branch sections.

5. The apparatus according to claim 1, further comprising a support member joined to the upper section at the junction, having a tail section that extends between the branch sections and a pair of arms, each of the arms extending upward and joining the upper section, and wherein a line equally bisecting the arms and passing through the axis of the upper section is substantially perpendicular to a line equally bisecting each of the branch sections and passing through the axis.

6. The apparatus according to claim 5, wherein the tail section comprises a pair of ribs interconnected by a web that is located in a plane that bisects the arms, the web defining an inner separation wall between the branch sections at the junction with the upper section and having an upper portion of substantially constant section sideways.

7. The apparatus according to claim 5, wherein the arms move farther apart from each other when moving from the collapsed position to the expanded position.

8. The apparatus according to claim 5, further comprising a stress relief notched with a radius formed at a comer of each of the arms with the tail section.

9. A well casing junction apparatus for connecting an upper string of casing to a pair of lower strings of casing, comprising:

an upper section having a longitudinal axis and being adapted to be connected to the upper string of casing above the apparatus, the upper section being a circular member having outer side wall portions that face laterally away and oppositely from each other;

a pair of branch sections that join each other at a junction with each other and with a lower end of the upper section and extend downward from the upper section for connection to the lower strings of casing, each of the branch sections having inner side wall portions that are located adjacent to and face laterally toward each other, and outer side wall portions that face laterally away and oppositely from each other;

the apparatus being movable due to the application of internal pressure from a collapsed position to an expanded position in which both of the branch sections are substantially cylindrical; and wherein while in the collapsed position, a lower portion of each of the outer side wall portions of the upper section is deformed into a configuration having a single depression; and while in the collapsed position, an tipper portion of the outer side wall of each of the branch sections is deformed into a configuration having a single depression that extends downward from one of the depressions of the upper section, each of the depressions of the branch sections being in substantial contact with an interior surface of the inner side wall portion of each of the branch sections.

10. The apparatus according to claim 9, wherein while moving from the collapsed position to the expanded position, an upper section minor axis dimension increases, the upper section minor axis dimension being measured across the lower portion of the upper section in a plane perpendicular to a line bisecting equally each of the branch sections.

11. The apparatus according to claim 9, wherein while moving from the collapsed position to the expanded position, an upper section major axis dimension increases, the upper section major axis dimension being measured perpendicular to an upper section minor axis dimension across the lower portion of the upper section.

12. The apparatus according to claim 11, wherein while moving from the collapsed position to the expanded position, a branch section major axis dimension increases, the branch section major axis dimension being measured across the branch sections from the outer side wall portion of one of the branch sections to the outer side wall portion of the other of the branch sections.

13. The apparatus according to claim 9, further comprising a support member joined to the upper section at the junction, having a tail section that extends between the branch sections and a pair of arms, each of the arms extending upward and joining the upper section, and wherein a line equally bisecting the arms and passing through the longitudinal axis of the upper section is substantially perpendicular to a line equally bisecting each of the branch sections and passing through the longitudinal axis.

14. The apparatus according to claim 13, wherein the tail section comprises a pair of ribs interconnected by a web that is located in a plane that bisects the arms, the web defining an inner separation wall between the branch sections at the junction with the upper section and having an upper portion of substantially constant thickness.

15. The apparatus according to claim 13, wherein the arms move farther apart from each other when moving from the collapsed position to the expanded position.

16. The apparatus according to claim 13, further comprising a stress relief notch with a radius formed at a comer of each of the arms with the tail section.

17. A method for providing a junction between an upper string of casing and two lower strings of casing, comprising:

(a) providing a junction apparatus that comprises an upper section and a pair of branch sections that join each other at a junction with each other and with a lower end of the upper section and extend downward from the upper section;

(b) collapsing the junction apparatus into a smaller effective diameter by forming two oppositely facing single depressions in a lower portion of the upper section, and forming a single depression in an outer side wall portion of each of the branch sections;

(c) connecting the upper section of the junction apparatus to the upper string of casing and running the junction apparatus into the well while collapsed;

(d) while the junction apparatus is in the well, applying an internal force to the junction apparatus to cause the depressions in the lower portion of the upper section and in the branch sections to substantially disappear, and causing the branch sections to move apart from each other.

18. The method according to claim 17, wherein step (d) causes a minor axis dimension across a lower portion of the upper section to increase, the minor axis dimension being measured substantially perpendicular to a line equally bisecting the branch sections.

19. The method according to claim 17, wherein step (d) also causes a major axis dimension across a lower portion of the upper section to increase, the major axis dimension being measured substantially perpendicular to a minor axis dimension.

20. The method according to claim 17, wherein step (d) is performed by applying internal fluid pressure to the junction apparatus.

21. The method according to claim 17, wherein one of the lower strings of casing is attached to one of the branch sections prior to running the junction apparatus into the well.

22. The method according to claim 21, wherein the other of the branch sections is plugged prior to running in the well, and step(d) is performed by applying internal fluid pressure to the junction apparatus.

* * * * *